US005640773A

United States Patent [19]

Haertlein

[11] Patent Number: 5,640,773

[45] Date of Patent: Jun. 24, 1997

[54] PORTABLE MOTOR-DRIVEN CUTTING TOOL, PARTICULARLY A POWER SAW OR THE LIKE

[76] Inventor: Reinhold Haertlein, Schulstrasse 6, D-91469 Hagenbüchach, Germany

[21] Appl. No.: 362,594

[22] PCT Filed: May 13, 1994

[86] PCT No.: PCT/DE94/00548

§ 371 Date: Feb. 22, 1995

§ 102(e) Date: Feb. 22, 1995

[87] PCT Pub. No.: WO94/26482

PCT Pub. Date: Nov. 24, 1994

[30] Foreign Application Priority Data

May 12, 1993 [DE] Germany ..... 43 15 852.8
Mar. 2, 1994 [DE] Germany ..... 44 06 744.5

[51] Int. Cl.[6] ..... B27G 19/00

[52] U.S. Cl. ..... 30/382; 30/383

[58] Field of Search ..... 30/382, 383, 381

[56] References Cited

U.S. PATENT DOCUMENTS

| | | | |
|---|---|---|---|
| 3,739,475 | 6/1973 | Moore | 30/383 |
| 3,793,727 | 2/1974 | Moore | 30/383 |
| 4,295,327 | 10/1981 | Bortolussi . | |
| 4,328,617 | 5/1982 | Satoh | 30/382 |
| 4,974,325 | 12/1990 | Hartlein | 30/383 |
| 5,101,567 | 4/1992 | Cool | 30/382 |
| 5,184,403 | 2/1993 | Schliemann | 30/382 X |

FOREIGN PATENT DOCUMENTS

| | | |
|---|---|---|
| 0-347-869 | 12/1989 | European Pat. Off. . |
| 2-548-574 | 1/1985 | France . |
| 2816-485 | 10/1979 | Germany . |
| 1170027 | 11/1969 | United Kingdom . |

*Primary Examiner*—Hwei-Siu Payer
*Attorney, Agent, or Firm*—Frank H. Foster; Kremblas, Foster, Millard & Pollick

[57] ABSTRACT

A safety system for power chain saws including two flanges which are mounted on a hand guard frame on the left and right sides. The flanges point toward the rear and trigger the chain brake in the event of the hand slipping laterally and impacting with sufficient force. A further safety system includes a hand lever which is attached to the handle. This mechanism permits starting up of the saw only if the hand lever is pressed against the grip.

10 Claims, 4 Drawing Sheets

PORTABLE MOTOR-DRIVEN CUTTING TOOL, PARTICULARLY A POWER SAW OR THE LIKE

TECHNICAL FIELD

The invention relates to a portable motor-driven cutting tool, particularly a power chain saw or hedge clipper, having a casing on the rear section of which a holding handle and controls are disposed and on the front section of which cutting elements are disposed and also a manipulating handle is articulated in such a way as to be lockable, rotatable or pivotable about an axis which extends substantially parallel to the cutting plane and serves to adjust the said cutting plane.

BACKGROUND ART

In a known power chain saw of this kind (cf. DE-28 16 485 and EP-O 347 869), a rear holding handle is provided on which the controls for switching the power chain saw on and off are disposed. In order to permit a change in the cutting plane of the sword, a rotatably mounted handle is articulated on the end face of the power saw. Compared with conventional handles, the rotatably mounted handle described in the two patent specifications displays a high standard from the safety engineering point of view.

Power chain saws are to be placed in the category of the most dangerous tools. The moving cutting chain can cause the severest injuries. The so-called "kickback" has proved to be the cause of most accidents. When "kickback" occurs, the cutting chain catches on the point of the guide bar, as a result of which the power chain saw is flung abruptly upwards and may be knocked out of the hand at the front being used to guide it. The hand at the rear, which continues to hold the power chain saw tightly, forms the point of rotation. The necessary averting reaction is scarcely possible, and the consequences are severe injuries to the arms, body and head.

As safety precautions, power chain saws conforming to the current state of the art are equipped with a hand-guard frame and a recoil mechanism, both of which can trigger the chain brake.

The chain brake is triggered in the event of a blow to the hand-guard frame, which is fitted to the upper side of the power chain saw. But if the hand is located on the holding frame at the side, this safety measure cannot come into operation. Even a hand-guard frame which rotates with the holding frame does not come into operation, since the point of rotation, in the event of the power chain saw being hocked upwards, is located at the rear holding handle.

In the case of power chain saws equipped with a recoil mechanism, the chain brake is triggered when the saw is knocked slightly upwards. The problem with the recoil mechanism is regulating the triggering value. If the setting is too light, the chain brake is constantly being triggered, and the rhythm of work is disrupted. Even if the power chain saw is knocked upwards in a plane other than that of the chain bar and is torn from the operator's hand, the moving cutting chain can still strike the operator's body. Because the saw is hocked upwards obliquely in relation to the plane of the chain bar, the triggering value of the recoil mechanism is not reached.

The way in which the chain brake incorporated in power chain saws works should be observed. The chain brake mechanism is linked to the hand-guard frame, which is located in a central position. The chain brake is released, but is already pre-tensioned. In the event of a forwardly directed blow to the hand-guard due to the power saw jerking abruptly upwards or any other reason, the chain brake stops the cutting tool. The lever of the chain brake is now located in the forward position. In order to release the chain brake, the hand-guard is pulled rearwardly (i.e. toward the rear handle) across the central position and into the rearward position. This causes the releasing of the chain brake (to allow the saw to be started), which, at the same time, pre-tensions the chain brake. When the hand-guard is released by the hand which pulled it into the rearward position, the hand-guard frame springs back automatically into the central position.

SUMMARY OF INVENTION

The invention relates to a safety system for power chain saws which is fitted to a rotatably mounted front handle (Pats. DE-28 16 485 and EP-O 347 869). According the prior art, the hand-guard frame, which is articulated on the handle, triggers the chain brake in the event of a blow towards the front. This safety system is not activated in the event of the handle slipping laterally. However, this lateral slipping involves major dangers, since there is nothing to prevent the power chain saw from striking the body. Two flanges, which are mounted on the hand-guard frame on the left and right sides and which point towards the rear, trigger the chain brake even in the event of the handle slipping laterally. Viewed from above, the hand-guard frame is U-shaped and is open towards the rear.

A further safety system is a mechanism which is connected to a hand lever which is articulated rotatably on the grip part of the handle.

This mechanism permits the starting-up of the cutting tool (sawing chain) only if the lever is pressed against the grip part and is firmly grasped with the hand. The chain brake is locked in position so that unintentional starting-up of the saw is not possible. The chain brake can be released and the saw started only when the hand lever is pulled to the grip part of the handle and held continuously against it. When the hand lever is pulled, the triggering lever of the chain brake is unlocked by means of a mechanism (100 or 100' shown as examples in FIGS. 4 and 5) and a Bowden cable putting the trigger lever in the rearward position. The mechanism then switches over and conveys the triggering lever of the chain brake into the central position. The chain brake is now released and pre-tensioned. (Via the Bowden cable, the triggering lever of the chain brake is also connected to a part on the hand-guard, which part locks the chain brake in the event of a blow to the hand-guard frame. ) This linking of the hand lever on the handle to the hand-guard frame provides the highest possible degree of safety according to the current state of the art. The power saw is only ready for use when the handle remains firmly grasped and the had-guard frame is not triggered (i.e. in the forward position).

Further advantages, features and details of the invention emerge from the sub-claims. It will be explained in greater detail with the aid of the following description of an example of embodiment and also with the aid of the drawings.

BRIEF DESCRIPTION OF DRAWINGS

Identical reference symbols in different figures designate parts which correspond to one another in terms of function.

DETAILED DESCRIPTION

Figure 2:
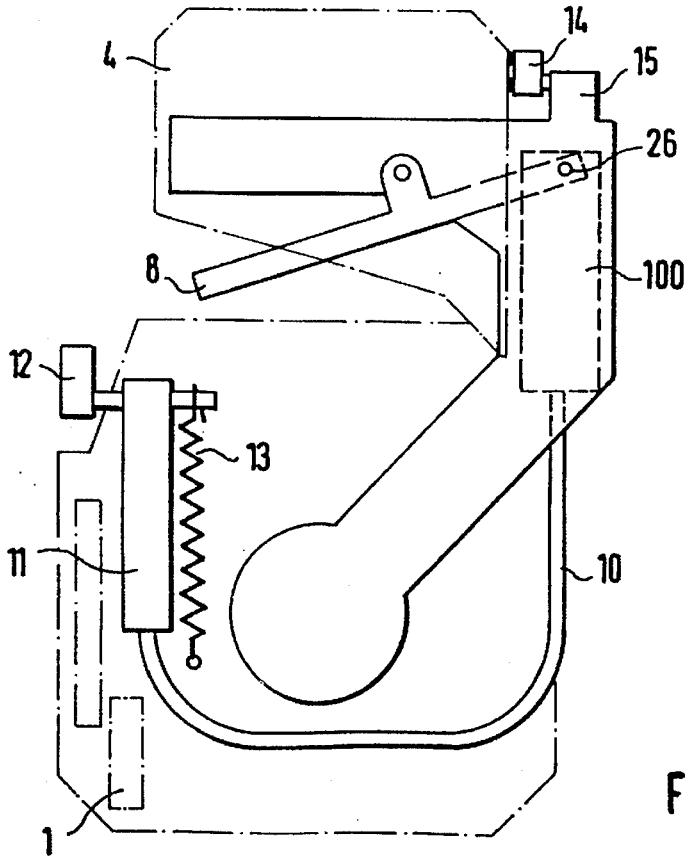
FIG. 2 is an end view of a power saw.
Figure 3:
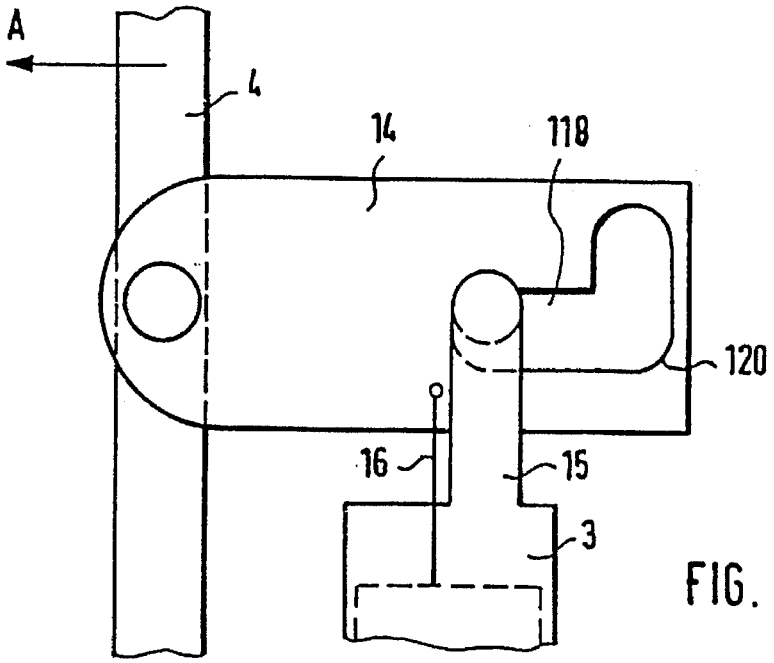
FIG. 3 is a side view of the triggering mechanism of the hand-guard.
Figure 4:
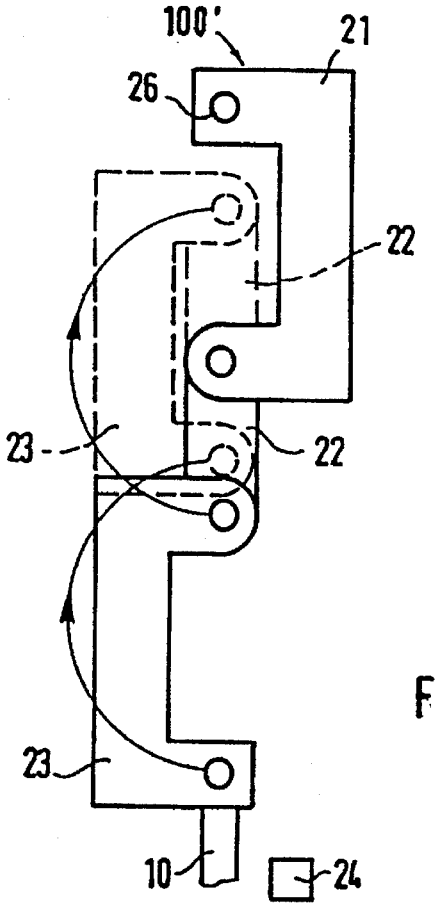
FIGS. 4 and 5 are two different examples of the switching-over mechanisms of the chain brake.
Figure 6:
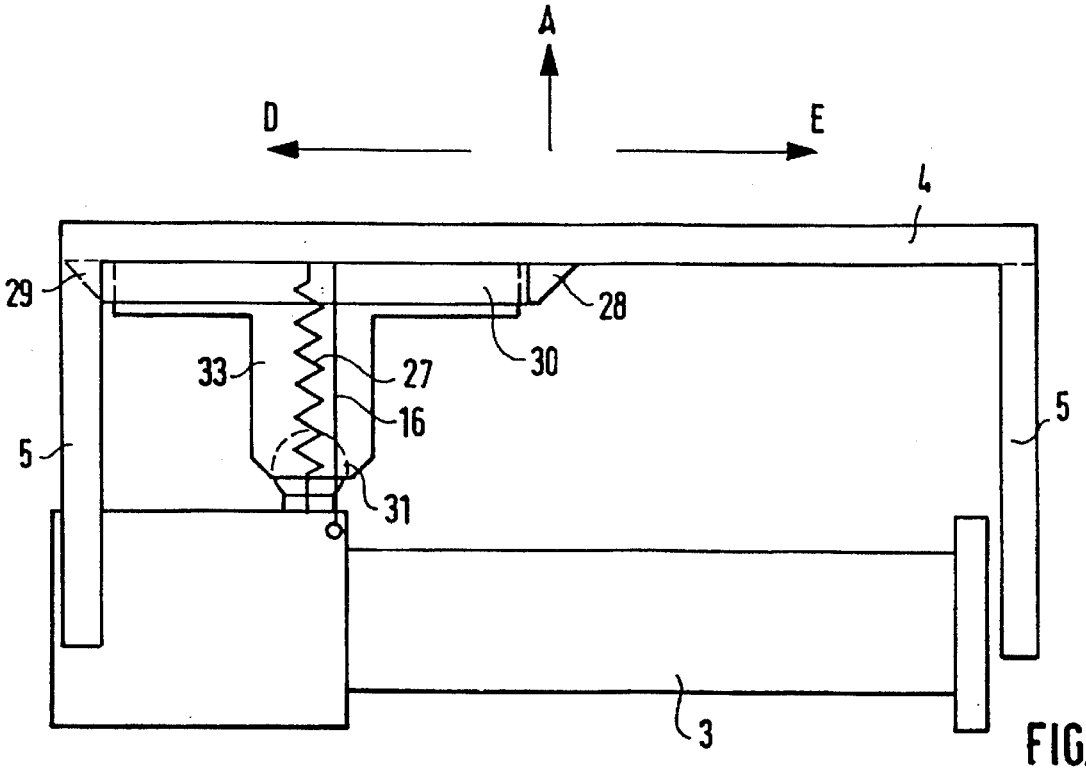
FIG. 6 is a plan view of the U-shaped had-guard frame attached to the handle.
Figure 7:
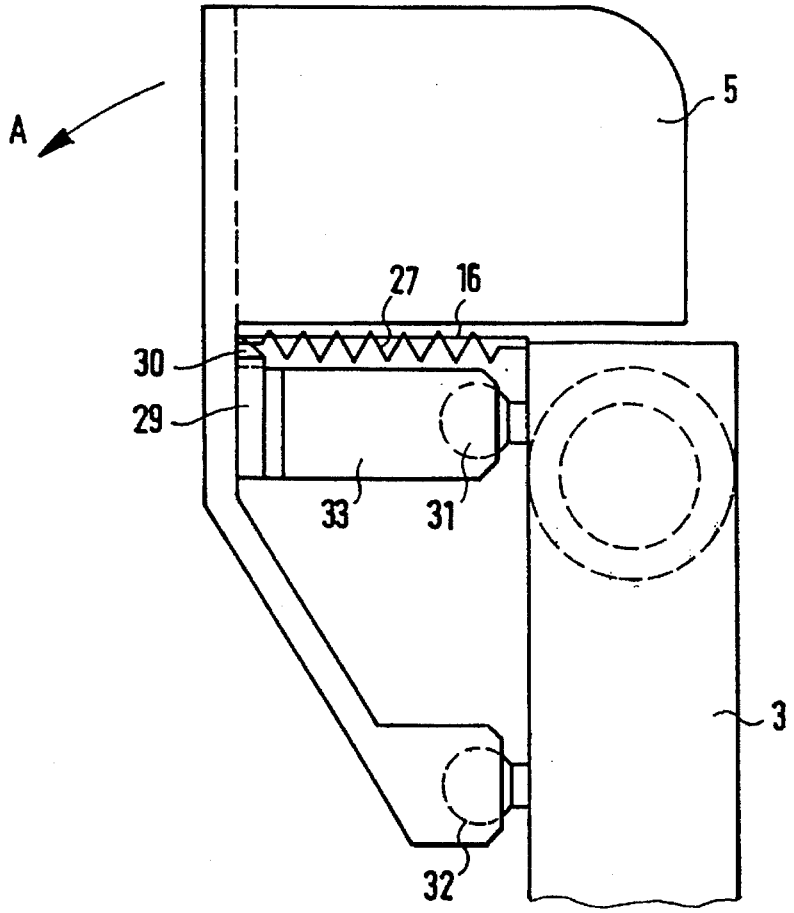
FIG. 7 is a side view of the U-shaped hand-guard frame attached to the handle.

According to the current state of the art, the conventional chain brake 1 is triggered only in the event of a blow to the hand-guard frame towards the front (direction A in FIGS. 3, 6 and 7). No protection is provided against a lateral slipping of the handle (direction D and E) (FIGS. 6 and 7). Mounted on the hand-guard frame 4 on the left and right sides are flanges 5 which point towards the rear. A lower ball joint or cross joint 32 is provided as the articulation for the hand-guard frame. The lower ball joint 32 is attached to the handle 3. A spring 27 is mounted at one end to the frame 4 and at the opposite end to the handle 3, and pulls the hand-guard frame 4 against the interposed countersupport 33, which is connected to the handle via an upper ball joint or cross joint 31. The countersupport 33 is of T-shaped construction and gives the hand-guard frame the necessary stability, in conjunction with the spring 27. The countersupport 33 seats against the rear of the hand-guard frame 4 between the stop 30 at the top, side stop 29 on the left and side stop 28 on the right. The hand-guard frame 4 is connected to the triggering lever 12 of the chain brake 1 (of FIG. 2) via the wire of the Bowden cable 16. In the case of a chain brake which is switched electrically (not illustrated), an electrical switch and an electrical cable connection are fitted, instead of the mechanical Bowden cable, as the triggering system for the chain brake.

In the event of lateral slipping of the handle (direction D or E in FIG. 6), the hand knocks against one of the two flanges 5. The countersupport 33 prevents the hand-guard frame 4 from folding back to the handle 3. When the hand-guard frame 4 is deflected laterally, it locks the chain brake by means of the Bowden cable 16 actuating the connected triggering lever 12 in a conventional manner.

A further system for increasing safety is shown in FIGS. 1 to 5.

Figure 5:
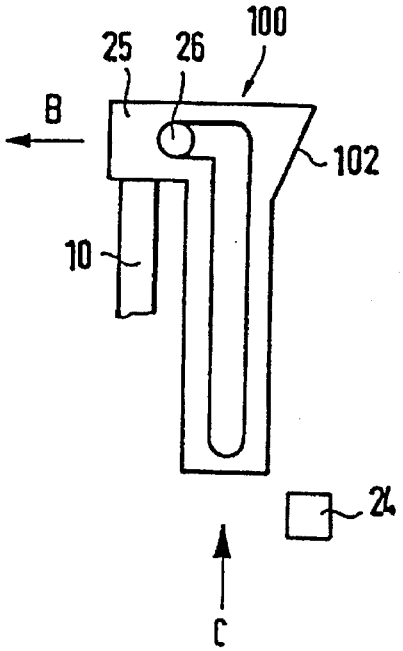
Figure 8:
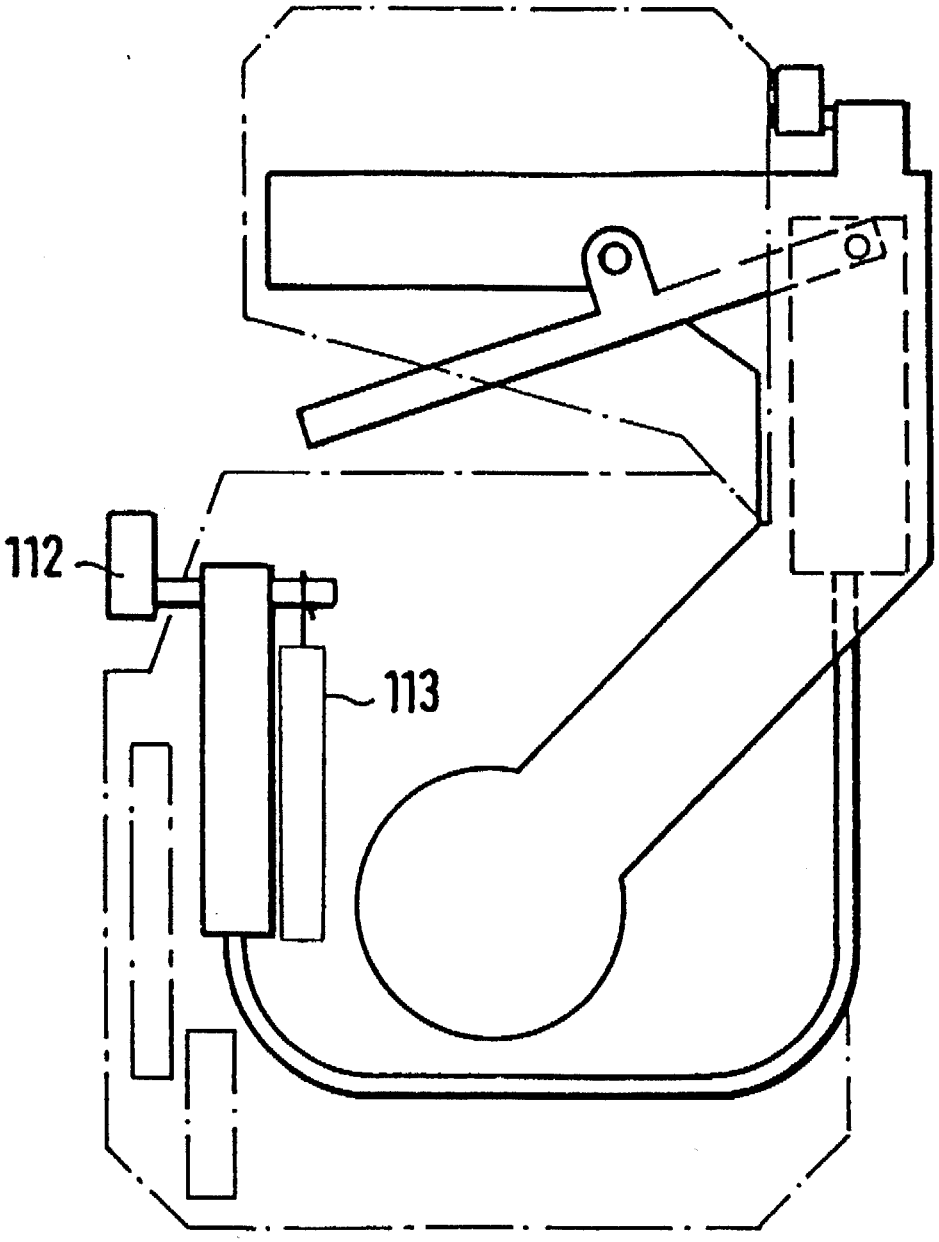
FIG. 8 is an end view of a power saw, showing the weight 113 attached to a trigger lever 112.

A spring 13, which is attached to the triggering lever 12 of the chain brake, holds the latter in the locked condition. A weight 113, as shown attached to the lever 112 in FIG. 8, can be substituted for the spring 13. In order to achieve unlocking, it is necessary to pull the hand lever 8 mounted on the front handle 3 against the grip part of the handle. This function can be carried out by grasping the handle 3 and the hand lever 8 with the hand and then clenching the hand. During this process of pulling the hand lever 8 against the handle 3, the metal pin 26 connected to the lever 8 displaces one of the mechanisms 100 or 100' (shown as examples in FIGS. 4 or 5) downwards. The mechanism 100, for example, is connected to the casing 10 of the Bowden cable. As the hand lever 8 is displaced, the pin 26 in the mechanism 100 forces the triggering lever 12 of the chain brake into the ordinary rearward position (described above) via the casing of the Bowden cable being displaced longitudinally and the intermediate piece 11 operating in a conventional manner to displace the triggering lever 12. This function unlocks the chain brake 1 and allows the saw to be started and run. After the chain brake 1 has been unlocked, the mechanism 100 travels slightly further until an inclined edge 102 slides against a stop 24. The stop 24 causes the part 25 to be displaced leftwardly, thereby switching the mechanism 100 over. (In FIG. 4, the mechanism 100' folds up as the lower link 23 hinges upwardly relative to the upper link 21 along the arrows and the bar 22 rotates 180°. In FIG. 5, the stop 24 pushes the part 25 in the direction B and the spring force of the spring 13 pushes the part 25 in the direction C up to the end of the longitudinal groove.) As a result of the switching-over of the mechanism 100 or 100', the spring 13 of FIG. 2 pulls the triggering lever 12 of the chain brake into the central position discussed above. The chain brake is unlocked and pre-tensioned and therefore ready for operation. In order to continue to obtain readiness for operation, the hand must grasp the grip part of the handle 3 and the lever 8 and press the lever 8 and press the lever continuously against the grip part. Releasing the lever 8 locks the chain brake.

Figure 1:
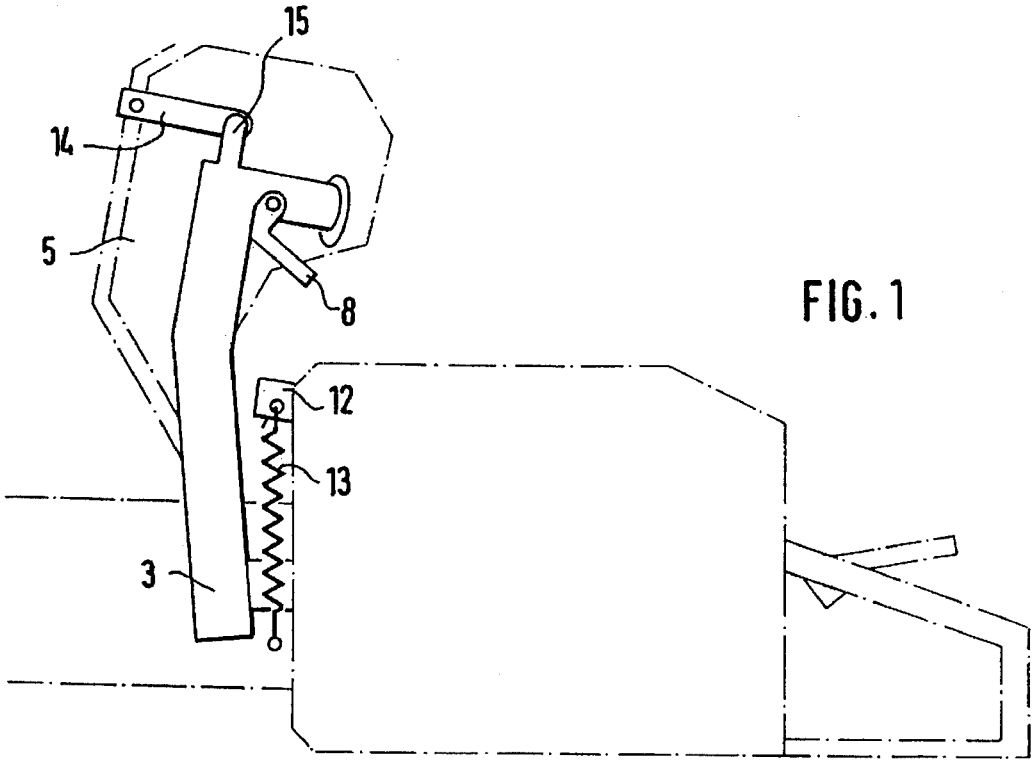
FIG. 1 is a side view of a power saw with an articulated manipulating handle.

This safety arrangement is also linked to the hand-guard as shown in FIGS. 1, 2 and 3.

One end of the wire 16 of the Bowden cable is attached to the part 14, which is pivotably connected to the hand-guard 4. In the event of a blow to the hand-guard frame 4 in the direction A, the hand-guard 4 pulls the part 14 (FIG. 3) out of its abutment with the finger 15 and along the long leg 118 of the L-shaped groove 120. At the rightward end of the groove 120, the part 14 drops down under a force applied to it by the wire 16, and releases the wire 16 of the Bowden cable. This simultaneously causes an easing of the pressure of the Bowden cable casing on the triggering lever 12 of the chain brake. The spring force of the spring 13, which is attached to the triggering lever 12, then locks the chain brake.

I claim:

1. An improved portable, motor driven cutting tool having a cutting blade extending longitudinally away from a tool handle, and a hand guard which is linked to a blade brake, the hand guard actuating the brake when the hand guard is displaced relative to the handle, the improvement comprising:

(a) a pivot joint linking the hand guard to the handle, the pivot joint permitting longitudinal and lateral pivoting of the hand guard about the pivot joint; and (b) first and second flanges rigidly mounted to opposite lateral sides of the hand guard, each of said flanges extending longitudinally from the hand guard as a cantilever beam, the flanges being configured to cause a displacement of the hand guard relative to the handle when a force, having a lateral component, is applied to at least one of said flanges.

2. A tool in accordance with claim 1, wherein the pivot joint further comprises a ball and socket joint.

3. A tool in accordance with claim 1, wherein the pivot joint further comprises:

(a) a first ball and socket joint pivotally mounting a lower end of the hand guard to the handle;

(b) a second ball and socket joint pivotally mounting a countersupport member to the handle, the countersupport member being mounted to the handle intermediate the flanges and the first ball and socket joint; and (c) a spring mounted to both the handle and the hand guard, for biasing the hand guard toward the countersupport member.

4. An improved portable, motor driven cutting tool having a front handle, a cutting blade extending away from the handle and a hand guard, the hand guard pivotably mounted to the handle and linked to an actuation lever of a blade brake, the actuation lever actuating the brake when the hand guard is displaced relative to the handle, the improvement comprising:

(a) a grip lever, pivotably mounted to the front handle and drivingly linked to the actuation lever, for displacing the actuation lever from an actuated, first position, to an unactuated, second position; and (b) a mechanical switch which is capable of seating against a mechanical stop, the switch being drivingly linked to the actuation lever and the grip lever, and when the actuation lever is displaced to the second position, the switch seats against the mechanical stop, switching the actuation lever from the second position to a third, unactuated and pretensioned, position.

5. A tool in accordance with claim 4, further comprising a bias mounted to the actuation lever, for biasing the actuation lever into the first position when the grip lever is released, thereby actuating the blade brake.

6. A tool in accordance with claim 5, wherein the bias is a spring.

7. A tool in accordance with claim 6, wherein the spring and the mechanical switch are integral parts of the blade brake.

8. A tool in accordance with claim 5, wherein the bias is a weight.

9. A tool in accordance with claim 4, further comprising:

(a) a pivot joint linking the hand guard to the handle, the pivot joint permitting longitudinal and lateral pivoting of the hand guard about the pivot joint; and (b) first and second flanges rigidly mounted to opposite lateral sides of the hand guard, each of said flanges extending longitudinally from the hand guard as a cantilever beam, the flanges being configured to cause a displacement of the hand guard relative to the handle when a force, having a lateral component, is applied to at least one of said flanges.

10. A tool in accordance with claim 9, wherein the pivot joint further comprises:

(a) a first ball and socket joint pivotally mounting a lower end of the hand guard to the handle;

(b) a second ball and socket joint pivotally mounting a countersupport member to the handle, the countersupport member being mounted to the handle intermediate the flanges and the first ball and socket joint; and (c) a spring mounted to both the handle and the hand guard, for biasing the hand guard toward the countersupport member.

* * * * *